US009245502B2

(12) United States Patent
Worrall

(10) Patent No.: US 9,245,502 B2
(45) Date of Patent: Jan. 26, 2016

(54) HOOP FOR A DRUM

(71) Applicant: Scott Worrall, Madrid, IA (US)

(72) Inventor: Scott Worrall, Madrid, IA (US)

( * ) Notice: Subject to any disclaimer, the term of this patent is extended or adjusted under 35 U.S.C. 154(b) by 0 days.

(21) Appl. No.: 14/301,800

(22) Filed: Jun. 11, 2014

(65) Prior Publication Data

US 2014/0360338 A1 Dec. 11, 2014

Related U.S. Application Data

(60) Provisional application No. 61/833,539, filed on Jun. 11, 2013.

(51) Int. Cl.
*G10D 13/02* (2006.01)

(52) U.S. Cl.
CPC ..... *G10D 13/023* (2013.01)

(58) Field of Classification Search
USPC ..... 84/411 R
See application file for complete search history.

(56) References Cited

U.S. PATENT DOCUMENTS

| | | | | |
|---|---|---|---|---|
| 4,475,434 | A * | 10/1984 | Willis | 84/411 R |
| 5,450,780 | A | 9/1995 | Hoshino | |
| 6,953,883 | B1 | 10/2005 | Jacobson | |
| 7,501,567 | B1 * | 3/2009 | Spinazzola | G10D 13/023 84/411 R |
| 8,686,264 | B2 * | 4/2014 | Morita | G10D 13/02 84/413 |
| 2002/0092406 | A1 * | 7/2002 | Hagiwara | 84/411 R |
| 2003/0121397 | A1 * | 7/2003 | May | G10D 13/023 84/411 R |
| 2011/0219938 | A1 * | 9/2011 | McBain | G10D 13/026 84/421 |
| 2014/0026732 | A1 * | 1/2014 | Spinazzola | G10D 13/028 84/413 |
| 2014/0123831 | A1 * | 5/2014 | Dunnett | 84/411 R |

* cited by examiner

*Primary Examiner* — Christopher Uhlir
(74) *Attorney, Agent, or Firm* — Zarley Law Firm, P.L.C.

(57) ABSTRACT

A hoop for a drum is presented. The hoop having a ring having an inward face, an outward linear plane face, a top edge, and a bottom edge, wherein the inward face is stepped such that the bottom edge has a width less than the width of the top edge and a shoulder is formed therebetween.

16 Claims, 2 Drawing Sheets

HOOP FOR A DRUM

CROSS REFERENCE TO RELATED APPLICATIONS

This application claims the benefit of U.S. Provisional Application No. 61/833,539, filed Jun. 11, 2013.

BACKGROUND OF THE INVENTION

This invention is directed to a hoop for a drum. Hoops for drums are known in the art. Drums typically have a layer of membrane or a plastic skin that is stretched over a frame and pulled taut. A drum hoop is a ring that holds the drum head (i.e., membrane) stretched tightly over one end of a generally cylindrical shell.

The hoop may be adjusted relative to the shell to tighten or loosen the drumhead by the adjustment of a plurality of bolts mounted around the circumference of the shell and hoop through a boss, tab, or ear.

Older wooden designs do not offer much structural integrity, do not hold consistent tuning due to variables in the weather that changes or warps the shape of the wood, are highly prone to damage due to stick battering, and are very difficult to mount microphone clips too. Metal hoop designs improve on the structure slightly, but due to their thin metal flange construction, are also prone to twisting and deformation over time and under high tensions. Other metal flange hoop designs also cause significant stick damage and premature stick failure due to the thin structure on the top section of the hoop when struck with a stick. This thin top section also offers very little variation in the tonality and playability of what is commonly known as a "rim shot". Thus, there is a need in the art to improve on all of these deficiencies.

An objective of the present invention is to improve the consistency and uniformity of the tunability of the drum.

Another objective of the present invention is to provide a metal hoop having greater rigidity.

A still further objective is to provide a hoop that is more acceptable to receiving attachments.

Yet another objective is to provide a hoop that modifies and produces a unique and clear tone when struck.

These and other objectives will be apparent to one of ordinary skill in the art based upon the following written description.

SUMMARY OF THE INVENTION

A hoop for a drum has a ring with an inward face, an outward linear plane face, a top edge, and a bottom edge. In one embodiment the ring has at least one cutout portion along the top edge that makes the cutout portion of the top edge have a width smaller than the rest of the top ring. The cutout portion is of such a nature as to receive a microphone clip.

In one iteration of the hoop the top edge is angled from the top edge to the shoulder. In another, a plurality of bosses extend from the top edge to the bottom edge. The bosses have openings that receive a bolt for tuning the drum. In this manner, the hoop provides for superior tunability of a drum and produces a unique and clear tone when struck while reducing the damage caused to a drumstick.

DETAILED DESCRIPTION OF THE PREFERRED EMBODIMENTS

Figure 1:
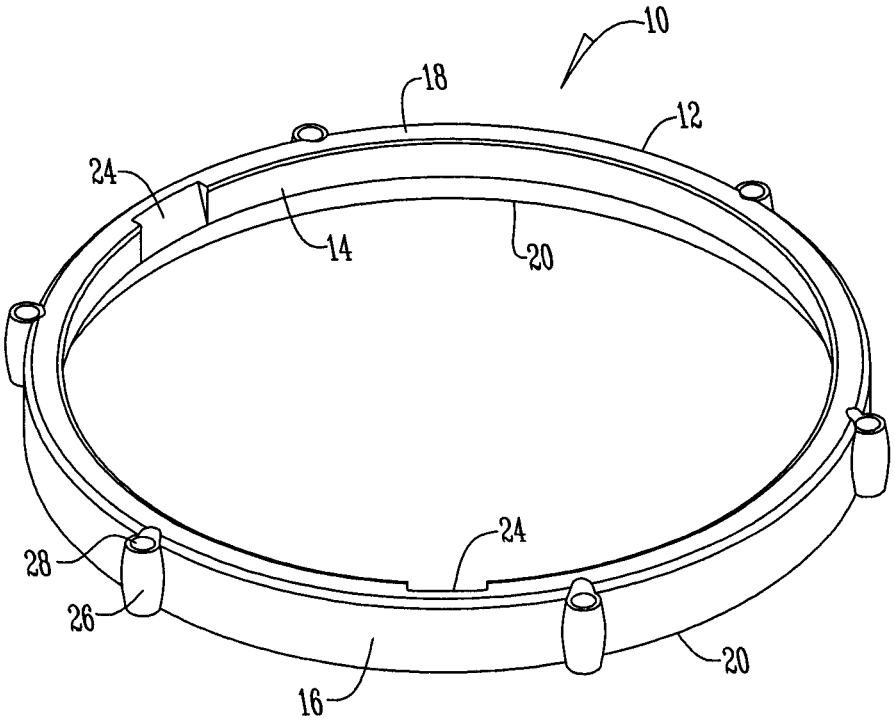
FIG. 1 is a perspective view of the hoop for a drum.
Figure 2:
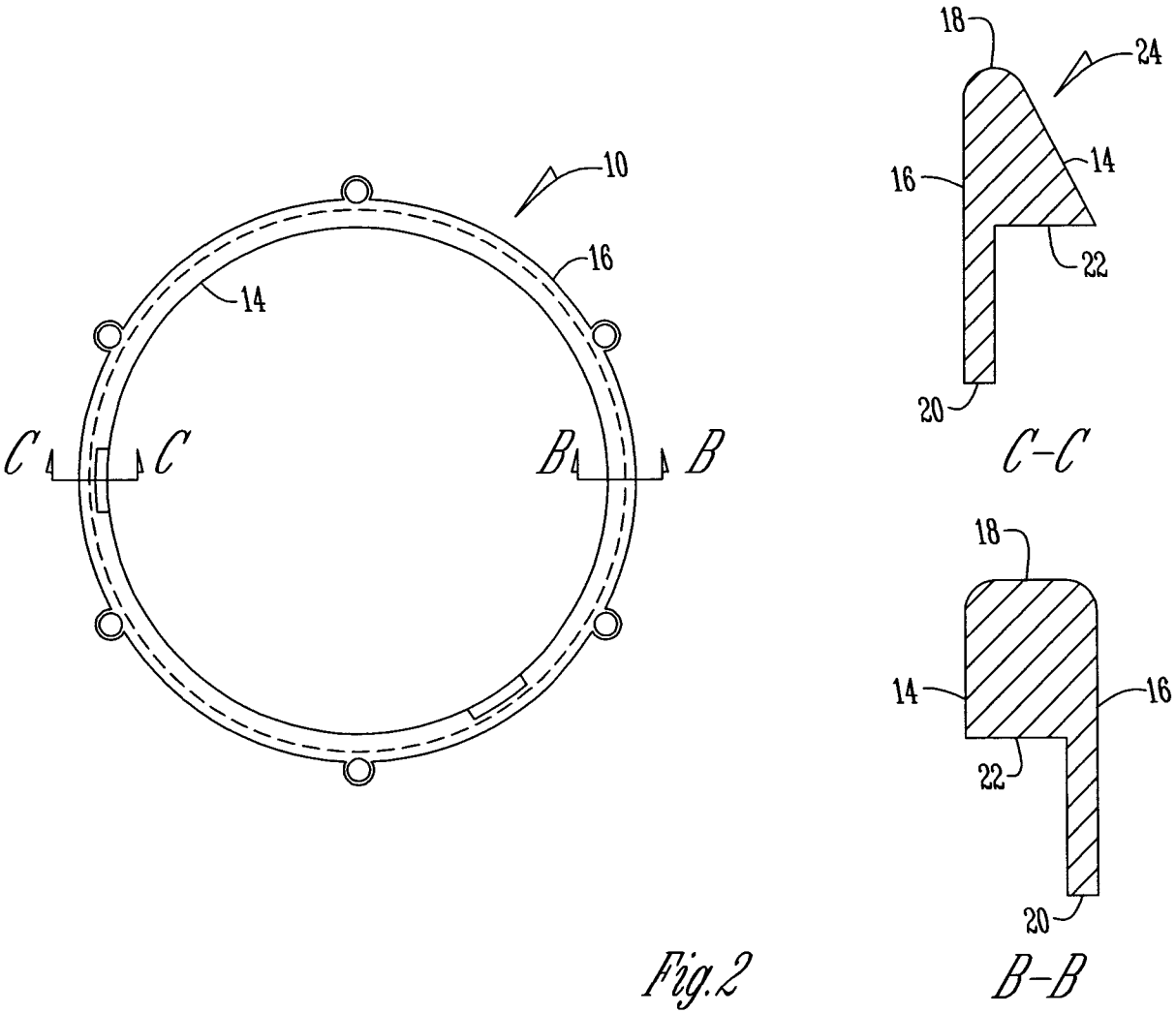
FIG. 2 is a cross section view of the hoop for a drum.

Referring to the Figures, a drum hoop 10 is formed from an annular ring 12 having an inward face 14, outward linear plane face 16, a top edge 18, and a bottom edge 20. Preferably the ring 12 is die cast using high tensile aluminum, aluminum zinc alloy, or the like. In other arrangement the drum hoop 10 is of any shape and size including triangular and rectangular.

The inward face 14 is stepped such that the bottom edge 20 has a width or thickness less than the width or thickness of the top edge 18 and a shoulder 22 is formed therebetween. This adds to the rigidity of the hoop 10 as compared to conventional designs. Preferably the top edge 18 has a width or thickness of between ¼ inch and ⅜ inch at the widest point. The thickness of the top edge 18 adds to the consistency and uniformity of the tunability of the drum, plus modifies the tonal characteristics of the hoop 10 when struck to create a unique and pure tone. Also, the thick top edge 18 is more stick friendly such that sticks last longer.

At least one, and preferably more, cutouts or indentations 24 are positioned at various portions the ring 12 of the hoop 10 such that the top edge 18 for the portion cutout 24 has a width less than the top edge 18 of the rest of the hoop 10. In one embodiment the inward face 14 is angled or tapered from the top edge 18 to the shoulder 22. The more narrow top edge 18 of the cutout 24 permits the attachment of microphone clips and the like regardless of brand.

Cast to the outward face 16, and extending from the top edge 18 to bottom edge 20 are a plurality of bosses 26. The bosses 26 have an opening 28 that receives a bolt or tension rod that is used for tuning the drum. By extending the boss 26 from the top edge 18 to the bottom edge 20, the load originator is closer to the top edge 18 of the hoop 10 and is spread across the hoop's length. This arrangement reduces the twisting and deformation of the hoop 10.

Thus, a hoop 10 for a drum has been disclosed that at the very least meets the stated objectives.

From the above discussion, it will be appreciated that the hoop presented improves upon the state of the art. Thus it is a primary objective of the invention to provide a hoop that improves upon the state of the art. That is, the hoop presented improves the consistency and uniformity of the tunability of the drum; provides a metal hoop having greater rigidity; is more acceptable to receive attachments; and modifies and produces a unique and clear tone when struck.

Due to the uniform linear plane of the outside profile of this hoop, as opposed to the stepped profiles used in other designs, the structural integrity in the direction that tension is used for this device is greatly improved over all other designs. Other features that improve on the structure of this device also include a complete casting of the bosses from near the top of the hoop through to the bottom for all boss attachments. This full boss casting virtually eliminates the possibility of twisting which can occur with other designs.

It will be appreciated by those skilled in the art that other various modifications could be made to the device without parting from the spirit and scope of this invention. All such modifications and changes fall within the scope of the claims that are intended to be covered thereby.

What is claimed is:

1. A hoop for a drum, comprising:

a ring having an inward face, an outward linear plane face, a top edge, and a bottom edge, such that an outside profile of the ring has a uniform linear plane from the top edge to the bottom edge;

wherein the inward face is stepped such that the bottom edge has a width less than a width of the top edge and a shoulder is formed therebetween; and the inward face having a portion that is tapered from the top edge to the shoulder from the rest of the inward face to form a cutout that receives a clip.

2. The hoop for a drum of claim 1 wherein the ring is made of high tensile aluminum.

3. The hoop for a drum of claim 1 wherein the ring is made of high tensile aluminum zinc alloy.

4. The hoop for a drum of claim 1 wherein the ring is made of a castable metal.

5. The hoop for a drum of claim 1 wherein the top edge has a thickness of at least ¼ inch at a widest point.

6. The hoop for a drum of claim 1 wherein the top edge has a thickness between ¼ inch and ⅜ at a widest point.

7. The hoop for a drum of claim 1 further comprising at least one cutout portion positioned around the ring.

8. The hoop for a drum of claim 7 wherein a top edge for the at least one portion cutout has a width less than the rest of the top edge.

9. The hoop for a drum of claim 7 wherein the at least one cutout portion receives a microphone clip.

10. The hoop for a drum of claim 1 wherein the inward face is angled from the top edge to the shoulder.

11. The hoop for a drum of claim 1 further comprising a plurality of bosses extending from the top edge to the bottom edge.

12. The hoop for a drum of claim 11 wherein the bosses have an opening that receive a bolt to tune the drum.

13. The hoop for a drum of claim 11 wherein the bosses are cast to the outward face.

14. The hoop for a drum of claim 1 wherein the ring is die cast.

15. A hoop for a drum, comprising:

a ring having an inward face, an outward linear plane face, a top edge, and a bottom edge, wherein the inward face is stepped such that the bottom edge has a width less than the width of the top edge and a shoulder is formed there between, and a plurality of bosses cast to the outward linear plane face that extend from the top edge to the bottom edge of the ring; and the inward face having a portion that is tapered from the top edge to the shoulder from the rest of the inward face to form a cutout that receives a clip.

16. A hoop for a drum, comprising:

a ring having an inward face, an outward linear plane face, a top edge, and a bottom edge, wherein the inward face is stepped such that the bottom edge has a width less than the width of the top edge and a shoulder is formed there between; and the inward face having portion that is tapered from the top edge to the shoulder from the rest of the inward face to form a cutout that receives a clip.

* * * * *